US006298217B1

(12) United States Patent
Murayama et al.

(10) Patent No.: US 6,298,217 B1
(45) **Date of Patent: *Oct. 2, 2001**

(54) CLEANING APPARATUS AND PROCESS CARTRIDGE

(75) Inventors: Kazunari Murayama, Shizuoka-ken; Tomonori Mori, Numazu, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,608

(22) Filed: Sep. 24, 1997

(30) Foreign Application Priority Data

Sep. 30, 1996 (JP) ..... 8-278961

(51) Int. Cl.[7] ..... G03G 21/10

(52) U.S. Cl. ..... 399/358; 399/360

(58) Field of Search ..... 399/358, 360, 399/123

(56) References Cited

U.S. PATENT DOCUMENTS

| | | | |
|---|---|---|---|
| 4,140,389 | * | 2/1979 | Franke . |
| 4,522,487 | | 6/1985 | Misawa . |
| 4,530,594 | * | 7/1985 | Adachi . |
| 4,768,062 | * | 8/1988 | Tanzawa et al. . |
| 4,958,196 | * | 9/1990 | Fujii et al. . |
| 5,031,001 | * | 7/1991 | Kusumoto . |
| 5,298,952 | * | 3/1994 | Kamijo et al. . |
| 5,341,200 | * | 8/1994 | Thomas . |
| 5,383,011 | * | 1/1995 | Numagami et al. . |
| 5,406,365 | * | 4/1995 | Baba et al. . |
| 5,617,194 | * | 4/1997 | Morishita et al. ..... 399/349 |
| 5,617,195 | | 4/1997 | Torimaru et al. . |

FOREIGN PATENT DOCUMENTS

| | | |
|---|---|---|
| 3020610 | 12/1980 | (DE) . |
| 0217173 | 4/1987 | (EP) . |
| 0382471 | 8/1990 | (EP) . |

OTHER PUBLICATIONS

Pat. Abs. Jap., vol. 087, No. 087 (P–1173), Feb. 1991 (JP 02 302 784).

Pat. Abs. Jap., vol. 010, No. 097 (P–446), Apr. 1986 (JP 60 230 178).

Pat. Abs. Jap., vol. 017, No. 246 (P–1536) May 1993 (JP 04 366877).

* cited by examiner

*Primary Examiner*—Richard Moses
(74) *Attorney, Agent, or Firm*—Fitzpatrick, Cella, Harper & Scinto

(57) ABSTRACT

A cleaning container having a highly durable drum in which removed toner is efficiently accumulated by toner conveyance having a backflow preventive function and upward conveyance. Optical fill-up detection is provided for detecting that the container is full of removed toner before a malfunction is caused. The cleaning container is divided into three chambers, a cleaning chamber, a removed toner accumulating chamber and an intermediate conveying chamber by one partition plate. In the cleaning chamber, toner is conveyed with a screw, and in the intermediate conveying chamber, toner is conveyed upward by a cylindrical impeller having ribs, guide. In removed toner small chambers partitioned with partition ribs, toner is stored from the upstream side with a screw partially having a reversed helical configuration, and in the small chamber at the most downstream side, the fill-up is optically detected. A cleaning member for fill-up detecting windows cleans in order of a top face window, then a side face window, and has ribs for preventing toner from flowing in at both sides of the windows.

101 Claims, 12 Drawing Sheets

CLEANING APPARATUS AND PROCESS CARTRIDGE

BACKGROUND OF THE INVENTION

1. Field of the Invention

The present invention relates to a process cartridge used in an electrophotographic image forming apparatus. Here, the electrophotographic image forming apparatus forms an image on a recording medium using an electrophotographic image forming system. Examples of the electrophotographic image forming apparatus include an electrophotographic copying machine, an electrophotographic printer (e.g. a laser beam printer, an LED printer or the like), a facsimile device, a word processor and the like.

For the process cartridge, at least a cleaning means and an electrophotographic photosensitive body are formed integrally into a cartridge. The cartridge is detachably attached to a main body of an image forming apparatus. Since a user can attach or detach the cartridge to or from the main body, the main body can be easily maintained.

2. Related Background Art

In a conventional image forming apparatus using an electrophotographic image forming process, an electrophotographic photosensitive body and a process means acting on the electrophotographic photosensitive body are formed integrally into a cartridge. The cartridge is detachably attached to a main body of an image forming apparatus. In this process cartridge system, since a user himself can maintain the apparatus without depending on a serviceman, operability can be remarkably enhanced. Therefore, the process cartridge system is widely used in the image forming apparatus.

A developing unit is separated from a process cartridge for an image forming process in which an electrophotographic photosensitive body, a charging means and a cleaning means are integrally formed. The units can be easily detachably mounted on a main body, and used in compliance with the lifetime of each main component. In the process cartridge, removed toner resulting from cleaning is stored in a cleaning container having a sufficient storage volume to conform with the lifetime of the electrophotographic photosensitive body. When replacing the process cartridge, the cleaning container is also removed.

SUMMARY OF THE INVENTION

The summary of invention is to provide a cleaning apparatus and the process cartridge with it which can contain the removed toner effectively.

Another object is to provide a cleaning apparatus and process cartridge which can extend the lifetime thereof.

Still another object is to provice a cleaning apparatus and the process cartridge which can maintain the cleaning ability longer than the conventional art.

Still another object is to provide the cleaning apparatus and the process cartridge in which the toner in the first chamber is fed to the opened portion by the toner convey member and then to the second chamber.

DETAILED DESCRIPTION OF THE PREFERRED EMBODIMENTS

Embodiments of the present invention are now described with reference to accompanying drawings. In the following description, the short direction of a process cartridge B coincides with the conveying direction of a recording medium. Also, the longitudinal direction of the process cartridge B is a direction in which the process cartridge B is detachably attached to a main body 13, parallel with a surface of the recording medium, and intersecting (substantially orthogonal to) the conveying direction of the recording medium. Further, left and right relative to the process cartridge indicate the left and the right directions of the recording medium seen from above along the conveying direction of the recording medium.

Embodiment 1

[Entire Constitution of Image Forming Apparatus]

Figure 1:
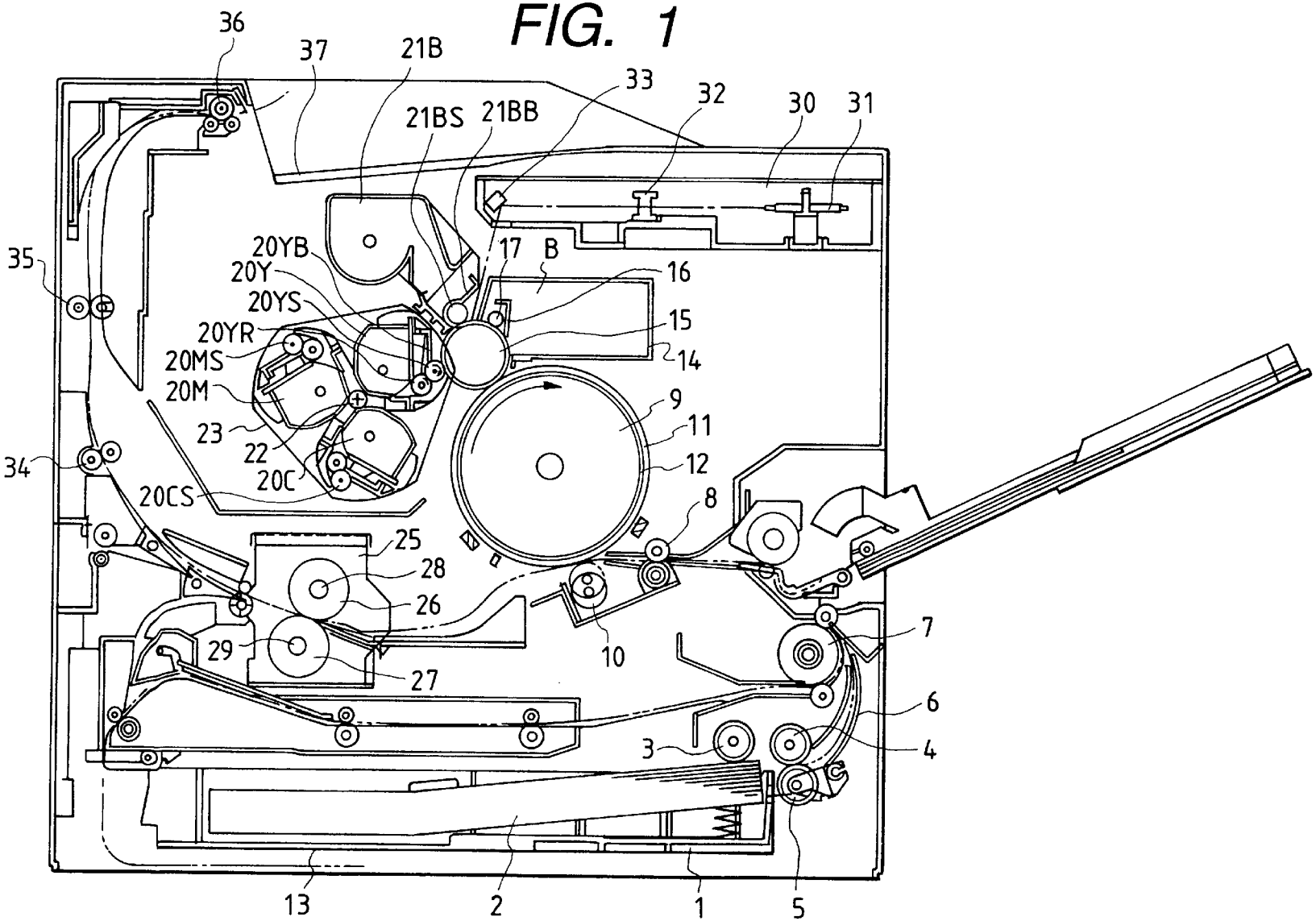
FIG. 1 is a longitudinal sectional view of a color laser printer according to a first embodiment of the present invention.

The entire constitution of the image forming apparatus is first described referring to FIG. 1.

FIG. 1 is an explanatory view of an entire constitution of a laser beam printer as a color image forming apparatus.

The color laser printer is, as shown in FIG. 1, provided with an image forming portion constituted of an image carrier 15 rotating at a constant rate, a fixed black developing unit 21B and three rotatable color developing units 20Y, 20M and 20C, and an intermediate transfer body 9 for holding a color image developed by the image forming portion and transferred in multiplicity and further transferring the color image onto a transfer material 2 as the recording medium supplied from a supply portion. The transfer material 2 with the color image transferred thereon is then conveyed to a fixing portion 25 to fix the color image on the transfer material 2, and is discharged via discharge rollers 34, 35 and 36 to a discharge tray 37 on a top face of the device. The rotatable color developing units 20Y, 20M and 20C and the fixed black developing unit 21B are separately detachably attached to the main body 13.

The constitution of each portion of the image forming apparatus is successively described.

[Electrophotographic Photosensitive Drum Unit]

The process cartridge B is constituted integrally with an electrophotographic photosensitive drum 15 and a cleaning container 14 also serving as a holder of the photosensitive drum 15. The process cartridge B is detachably attached and supported relative to the main body 13, and can be easily replaced as a unit in accordance with the lifetime of the photosensitive drum 15. The photosensitive drum 15 of the embodiment is constituted by applying an organic photoconductive layer to an outer periphery of an aluminum cylinder having a diameter of about 60 mm, and is rotatably supported by the cleaning container 14 also serving as the holder of the photosensitive drum 15. On the periphery of the photosensitive drum 15, a cleaning blade 16 and a primary charged means 17 are arranged. By transmitting a drive force of a drive motor (not shown) to one rear end as seen in FIG. 1, the photosensitive drum 15 is rotated counterclockwise in response to an image forming operation.

[Charging Means]

The charging means 17 uses a contact charging method, in which a conductive roller is in contact with the photosensitive drum 15. By applying voltage to the conductive roller, a surface of the photosensitive drum 15 is uniformly charged.

[Exposure Means]

The photosensitive drum 15 is exposed from a scanner portion 30. Specifically, when an image signal is given to a laser diode, the laser diode radiates an image beam corresponding to the image signal to a polygonal mirror 31. The polygonal mirror 31 is rotated at high speeds by a scanner motor. The image beam reflected by the polygonal mirror 31 is exposed via an imaging lens 32 and a reflective mirror 33 selectively to the surface of the photosensitive drum 15 rotating at a constant speed. As a result, an electrostatic latent image is formed on the photosensitive drum 15.

[Developing Means]

To visualize the electrostatic latent image, a developing means is constituted of three rotary developing units 20Y, 20M and 20C and one black developing unit 21B for developing in color of yellow, magenta, cyan and black, respectively.

The black developing unit 21B is a fixed developing unit. A sleeve 21BS is disposed opposite to the photosensitive drum 15 with a micro interval (about 300 $\mu$m) from the photosensitive drum 15, to form a visual image with black toner on the photosensitive drum 15.

In the black developing unit 21B, toner in the container is fed by a feeder mechanism. An application blade 21BB in contact under pressure with an outer periphery of the developing sleeve 21BS applies a thin layer of toner onto the outer periphery of the developing sleeve 21BS rotating clockwise in FIG. 1, while giving an electric charge (frictional electrification) to the toner. By applying a developing bias to the developing sleeve 21BS, toner is developed corresponding to the electrostatic latent image on the photosensitive drum 15.

Three rotary developing units 20Y, 20M and 20C are detachably supported by a developing rotary 23 dividing and rotating about a rotary rotation axis 22, respectively. When forming an image, the developing units held by the developing rotary 23 are rotated and moved centering on the rotary rotation axis 22. A specified one of the developing units is stopped at a position opposed to the photosensitive drum 15. Further, either one of developing sleeves 20YS, 20MS and 20CS is positioned opposite to the photosensitive drum 15 with a micro interval (about 300 $\mu$m), and a visual image is formed corresponding to the electrostatic latent image on the photosensitive drum 15. When forming a color image, every time the intermediate transfer body 9 is rotated once, the developing rotary 23 is rotated to perform a developing process in the following order: of the yellow developing unit 20Y, the magenta developing unit 20M, the cyan developing unit 20C, and subsequently the black developing unit 21B.

FIG. 1 shows that the yellow rotary developing unit 20Y is positioned and stands still opposite to the process cartridge B. In the rotary developing unit 20Y, the toner in the container is fed by the feeder mechanism to an application roller 20YR. The application roller 20YR rotating clockwise in FIG. 1 and an application blade 20YB in contact under pressure with an outer periphery of a developing sleeve 20YS apply a thin layer of toner to the outer periphery of the developing sleeve 20YS rotating clockwise, while giving an electric charge (frictional electrification) to the toner. By applying a developing bias to the developing sleeve 20YS opposed to the photosensitive drum 15 with a latent image formed thereon, the toner is developed in accordance with the latent image on the photosensitive drum 15. For the magenta developing unit 20M and the cyan developing unit 20C, toner is developed in the same mechanism as aforementioned.

The developing sleeves 20YS, 20MS and 20CS of the rotary developing units 20Y, 20M and 20C are, when rotated and moved to a developing position, connected to respective color developing high-voltage power sources and drives provided in the main body 13. The developing units are successively and selectively provided with a voltage and connected to the drives, respectively.

[Intermediate Transfer Body]

At the time of a color image forming operation, to receive multiple transfers of a toner image four times (images of four colors Y, M, C and B) visualized by the developing units 20Y, 20M and 20C on the photosensitive drum 15, the intermediate transfer body 9 is rotated clockwise synchronously with the speed of the outer periphery of the photosensitive drum 15. The intermediate transfer body 9 having received multiple transfers, together with a transfer roller 10 with a voltage applied thereto, holds and conveys the transfer material 2, so that each toner image on the intermediate transfer body 9 is concurrently transferred in multiplicity to the transfer material 2. The intermediate transfer body 9 of the embodiment is constituted by covering the outer periphery of an aluminum cylinder 12 having a diameter of 180 mm with a resilient layer 11 of an intermediate resistance sponge, an intermediate resistance rubber or the like. The intermediate transfer body 9 is rotatably supported and driven by an integrally fixed gear (not shown) to rotate.

[Cleaning Means]

Figure 2:
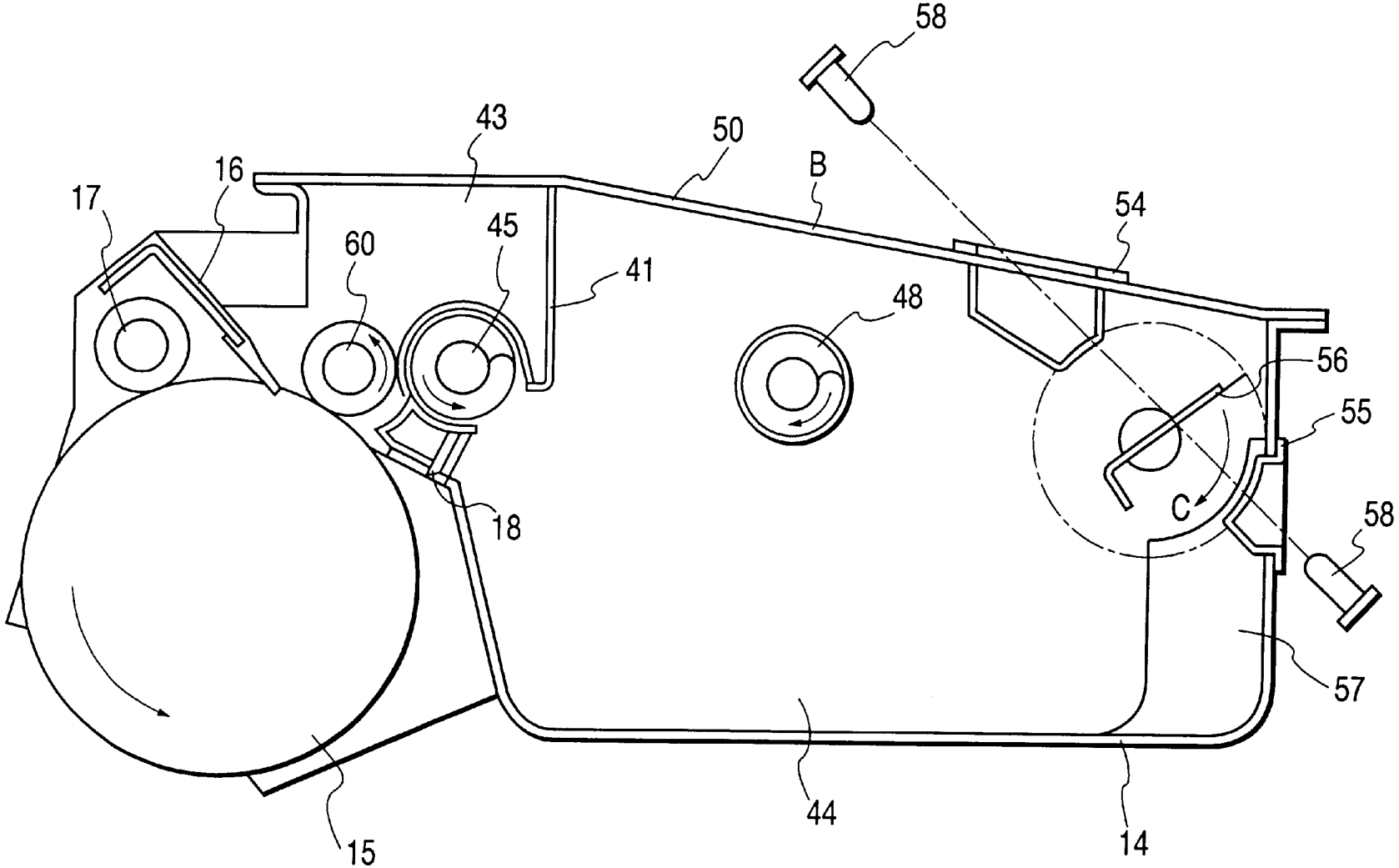
FIG. 2 is a longitudinal sectional view of a process cartridge according to the first embodiment.

After the toner image visualized on the photosensitive drum 15 is transferred to the intermediate transfer body 9, the cleaning means collects toner remaining on the photosensitive drum 15. The collected removed toner is stored in the cleaning container 14. In the embodiment, as shown in FIG. 2, for a moving direction of the periphery of the photosensitive drum 15, at the upstream side of a cleaning blade 16, a periphery of a cleaning roller 60 is slid with friction and moved while rotating in a reverse direction of the moving direction of the periphery of the photosensitive drum 15. The cleaning container 14 is integrally replaced at the same time when the photosensitive drum 15 is replaced at the expiration of its lifetime or is completely full with the removed toner. The constitution of the cleaning container 14 is detailed later.

[Sheet Supply Portion]

The sheet supply portion supplies the transfer material 2 to the image forming portion, and is constituted mainly of a sheet supply cassette 1 containing plural sheets of transfer material 2, a sheet supply roller 3, a feed roller 4, a retard roller 5 for preventing overlapped sheet supply, a sheet supply guide 6 and a regist roller 8. When forming an image, the sheet supply roller 3 is driven and rotated in response to an image forming operation, so that the transfer material 2 is supplied separately, sheet by sheet, from the sheet supply cassette 1, guided via the sheet supply guide 6 and conveyed via a conveying roller 7 to the regist roller 8. During the image forming operation, the regist roller 8 performs a non-rotating operation for stopping the transfer material 2 on standby and a rotating operation for conveying the transfer material 2 to the intermediate transfer body 9 in a predetermined sequence, and, at the subsequent transfer process, aligns an image with the transfer material 2.

[Transfer Portion]

The transfer portion is constituted of the swingable transfer roller 10 constituted of a metallic axis wound with an intermediate resistance foam resilient material, and is movable vertically as shown in FIG. 1 and driven by a drive source. When four-color toner images are formed on the intermediate transfer body 9, i.e. when the intermediate transfer body 9 is rotated plural times, not to disturb the images, as shown by a solid line, the transfer roller 10 is positioned below and distant from the intermediate transfer body 9.

Upon formation of the four-color images on the intermediate transfer body 9, in accordance with a timing when a color image is transferred to the transfer material 2, the transfer roller 10 is moved to an upper position shown by a thin line by a cam member (not shown), i.e. pushed against the intermediate transfer body 9 via the transfer material 2 with a predetermined pressure. At the same time, a bias is applied to the transfer roller 10, and the toner image on the intermediate transfer body 9 is transferred to the transfer material 2. Here, since the intermediate transfer body 9 and the transfer roller 10 are respectively driven, the transfer material 2 held between these undergoes the transfer process, and is simultaneously conveyed at a predetermined speed to the left in FIG. 1 toward the fixing portion 25 at the subsequent process.

[Fixing Portion]

The fixing portion 25 fixes the toner image transferred by the developing means 20 and 21 via the intermediate transfer body 9 onto the transfer material 2. As shown in FIG. 1, the fixing portion 25 is constituted of a fixing roller 26 for applying heat to the transfer material 2 and a pressure roller 27 for placing the transfer material 2 in contact with the fixing roller 26 under pressure. The rollers 26 and 27 are hollowed, have inside heaters 28 and 29, respectively, and are rotated and driven to convey the transfer material 2 at the same time. Specifically, the transfer material 2 holding the toner image is conveyed by the fixing roller 26 and the pressure roller 27, while given heat and pressure, so that the toner image is fixed on the transfer material 2.

[Cleaning Container]

Figure 3:
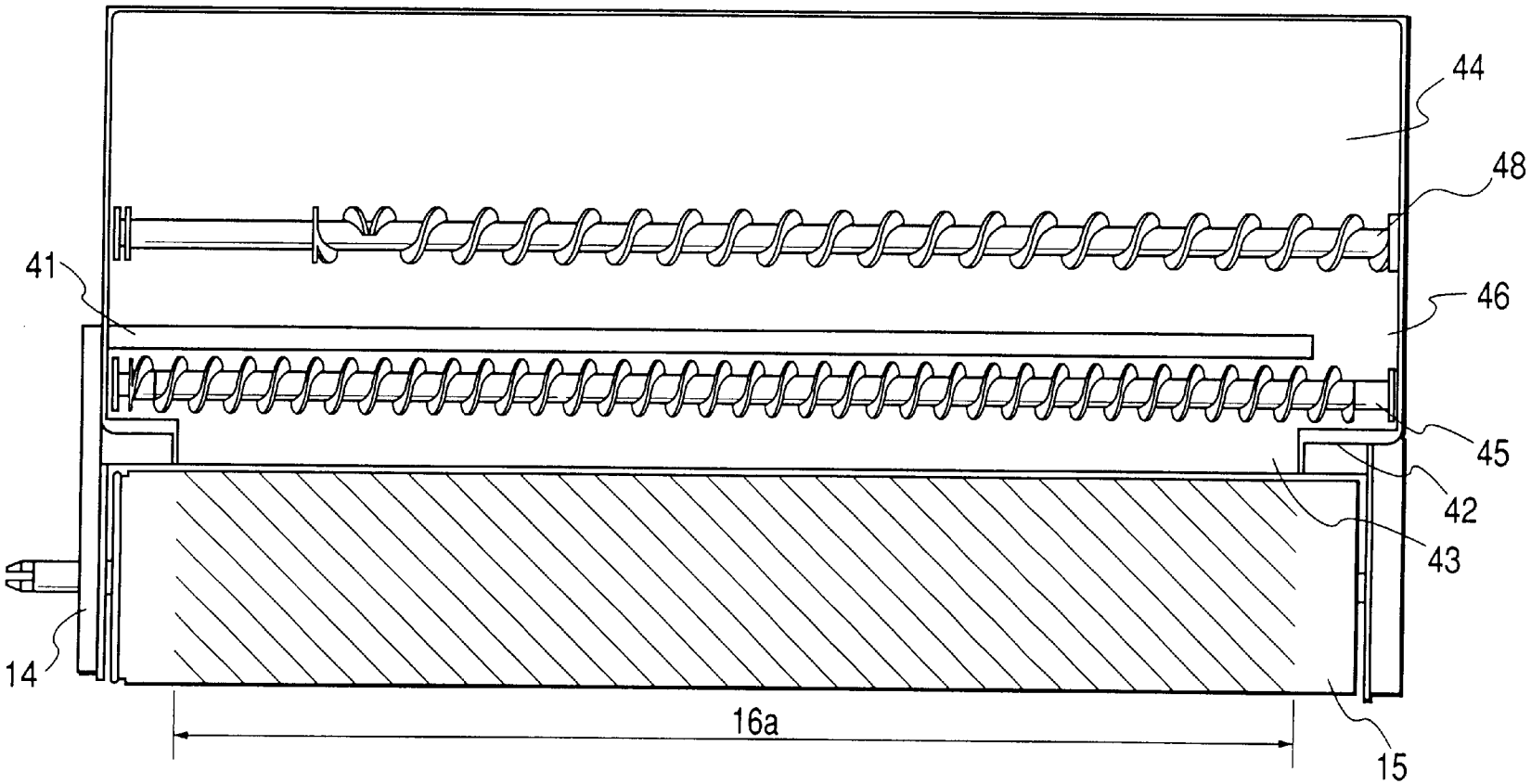
FIG. 3 is a horizontal sectional view of the process cartridge seen from above according to the first embodiment.
Figure 4:
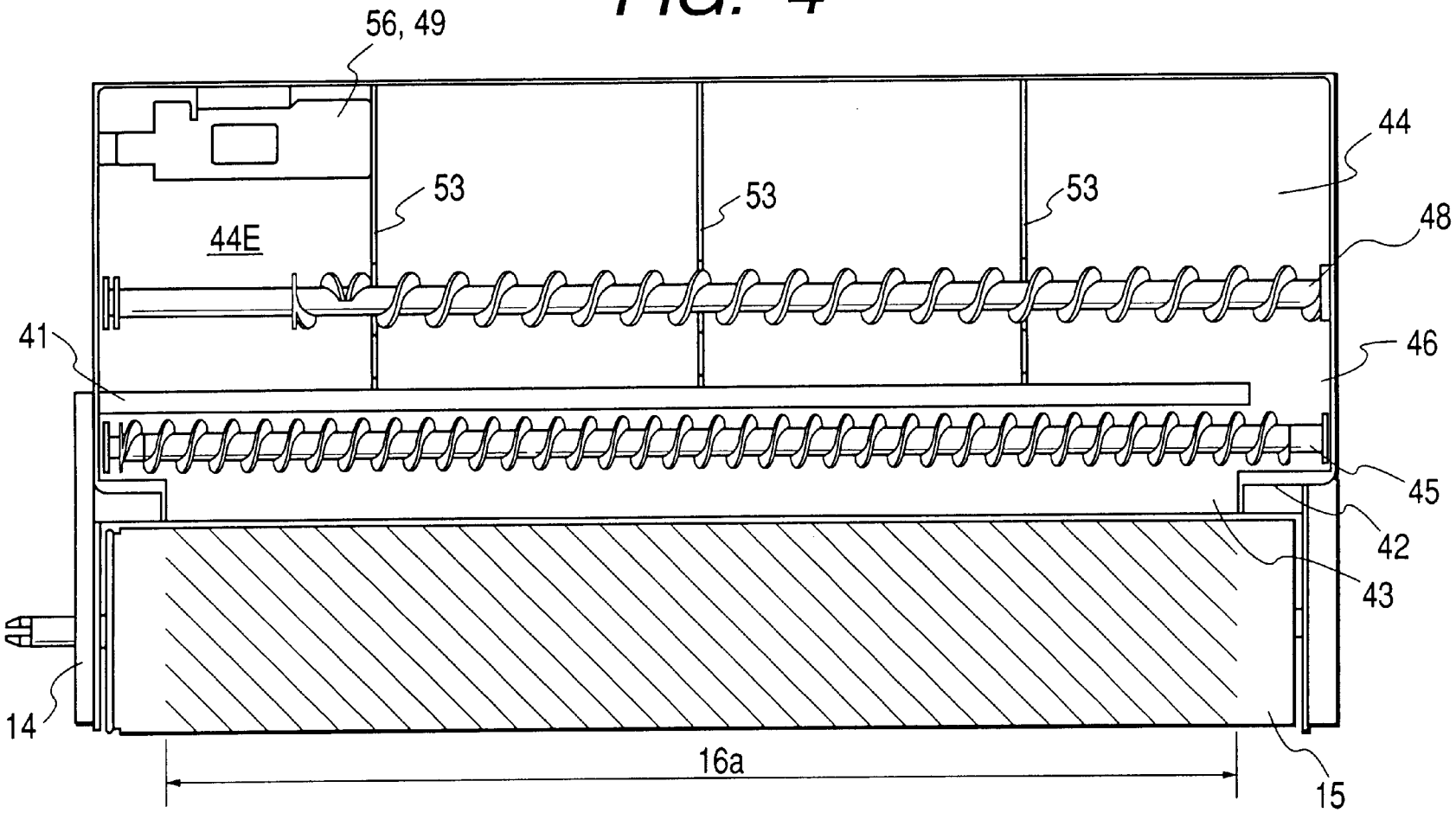
FIG. 4 is a horizontal sectional view of the process cartridge seen from above according to the first embodiment.

The cleaning container 14 is detailed with reference to FIGS. 2 and 3. The cleaning container 14 is provided with a partition member 41 for dividing the container into two, i.e., a cleaning chamber 43 and a removed toner accumulating chamber 44. In the vicinity of the partition member 41 is disposed a rotating screw a45 for moving the toner parallel to a longitudinal direction of the photosensitive drum 15. In the vicinity of a conveying terminal end of the screw a45, an opening 46 is provided in the partition member 41. In the vicinity of the opening 46, the screw a45 has an outer periphery surrounded by a constant length of a pressure wall 42.

In the cleaning chamber 43, the photosensitive drum 15 is cleaned with the cleaning blade 16 and the cleaning roller 60. According to the embodiment, in the cleaning container 14, the cleaning roller 60 abuts on the photosensitive drum 15 and rotates counterclockwise to frictionally slide on the photosensitive drum 15. Below the opening 46, a rake sheet 18 abuts with a certain angle on the photosensitive drum 15. The toner on the photosensitive drum 15 passes the abutting rake sheet 18 and enters the cleaning chamber 43. The toner is scraped off by the cleaning roller 60 and finally scraped down in the container by the cleaning blade 16. After cleaning, accumulated toner is fed by the cleaning roller 60 to the rear side of the container. In the embodiment, the cleaning roller 60 is used. When the cleaning is performed only with the cleaning blade 16, however, toner can be fed rearward by a feed blade or a stirring member instead of the cleaning blade 16.

When toner reaches the vicinity of the toner conveying member constituted of the rotating screw a45, by rotation of the screw a45, toner is conveyed parallel to the longitudinal direction of the photosensitive drum 15. The opening 46, which is configured so as to contact a rotation range of the screw a45 and formed in the partition member 41 for dividing the cleaning container 14 into two, is positioned at the terminal end of the conveying direction of the screw a45 outside a cleaning process range 16*a*. Further, the pressure wall 42 is positioned so as to surround the outer periphery of the screw a45. Therefore, the fed toner has a high particle pressure in the pressure wall 42, and securely goes via the opening 46 in the partition member 41 into the removed toner accumulating chamber 44. The screw a45 is molded in a helical form, but is not restricted to a molded screw as long as it is helical. For example, the screw a45 can be formed of a spring coil or another metallic material. In the cleaning chamber 43, a small quantity of toner always exists, but applies no excess particle pressure to the cleaning portion. Therefore, a stable cleaning can always be provided. Further, the pressure wall 42 surrounds a certain constant length of the conveying means of the screw a45, thereby preventing backflow.

During operation, even when the process cartridge B is attached to or detached from the main body 13 for cleaning another unit replacement device or the body 13, the toner accumulated in the removed toner accumulating chamber 44 is prevented from flowing in reverse to the cleaning chamber 43, or a large quantity of toner is prevented from flowing over the cleaning portion. Therefore, secure cleaning can be assured. Even removed toner increased in accordance with the highly durable photosensitive drum 15 or electrophotographic photosensitive drum can be securely stored. Further, when the highly durable photosensitive drum 15, having a large number of printable sheets, is removed at the expiration of its service duration, a user can easily replace or exchange the drum without manually making dirty the device, because removed toner is stored in the cleaning container 14.

In the embodiment, in the removed toner accumulating chamber 44, a screw b48 used as the removed toner conveying member has a longitudinal conveying direction in reverse to the conveying direction of the screw a45 in the cleaning chamber 43. The removed toner conveyed from the cleaning chamber 43 is successively conveyed by the conveying means to the removed toner accumulating chamber 44 to accumulate. In the removed toner accumulating chamber 44 is disposed the screw b48. When the accumulated removed toner reaches the screw b48, a conveying force is generated, so that toner is fed in a rotation axis direction of the screw b48 entirely into the removed toner accumulating chamber 44. As a result, removed toner resulting from the highly durable photosensitive drum 15 can be contained sufficiently in the removed toner accumulating chamber 44.

Figure 5:
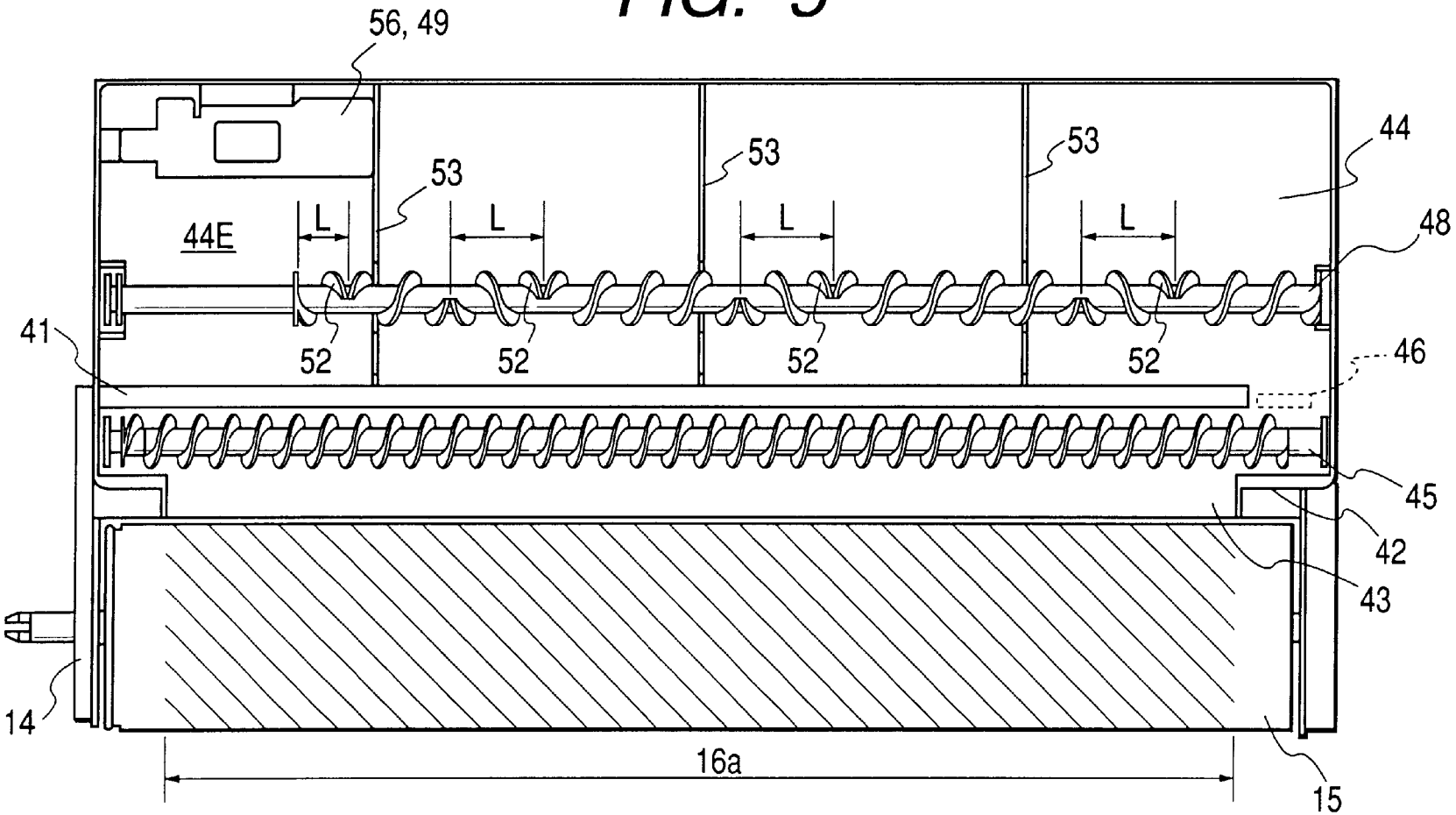
FIG. 5 is a horizontal sectional view of the process cartridge seen from above according to the first embodiment.

Further, as shown in FIG. 5, the helical configuration in the removed toner accumulating chamber 44 is modified in order to generate a conveying force directed in reverse to a main conveying direction at an arbitrary position, by providing a constant length of helical portion 52 at one or more places. In this constitution, the reversed helical portion 52 produces a conveying force for pushing back toner in reverse to the main conveying direction. As a result, the conveyed toner starts bulging centering on a start position of the reversed helical portion 52 from the axial direction to the radial direction. When the removed toner bulging in the radial direction becomes larger than the configuration of the reversed helical portion, toner is caught by the forward helical portions and again starts to be conveyed in a longitudinal forward conveying direction of the cleaning container 14. Also, when toner reaches a start position of the next reversed helical portion 52, toner starts accumulating centering on the reached point. By providing a reversed helical portion 52 in this manner, removed toner can be efficiently accumulated in the removed toner accumulating chamber 44.

Additionally, in the removed toner accumulating chamber 44, a plurality of removed toner partition ribs 53 are provided orthogonal to the rotation axis of the screw b48, to further divide the removed toner container 14 into small chambers. The removed toner chamber partition ribs 53 may protrude from the underside of the container 14, or be constituted integrally with the partition member 41 for dividing the container into the cleaning chamber 43 and the removed toner accumulating chamber 44. Alternatively, the ribs 53 can be constituted integrally with a container lid 50 on a top face of the cleaning container 14. By partitioning the removed toner accumulating chamber 44 with the removed toner chamber partition ribs 53, removed toner can be securely stored from the upstream side of the screw b48. After toner is efficiently stored sufficiently in each upstream small chamber, toner starts accumulating in small chambers at the downstream side. Therefore, removed toner can be efficiently stored in the entire volume of the container. Further, even if a user attaches or detaches the process cartridge B to or from the main body 13, the backflow preventing effect is further enhanced by each removed toner chamber partition rib 53. As a result, the process cartridge B having the highly durable photosensitive drum 15 can be stably provided.

Additionally, in the embodiment, among the small chambers partitioned by the removed toner chamber partition ribs 53, a small chamber 44E at the most downstream side is provided with a removed toner fill-up detecting means. The removed toner fill-up detecting means is optically operated. Light transmitting windows 54 and 55 are provided opposite to the top face and the rear side face of the removed toner accumulating chamber 44, respectively. By transmitting light to the small chamber 44E with light emitting and receiving portions 58 outside the process cartridge B, it is detected whether or not there exists removed toner.

In the embodiment by using the aforementioned removed toner conveying member, toner is conveyed finally into the small chamber 44E. When the accumulated removed toner reaches the windows of the fill-up detection means, light from the outside is interrupted by the toner, the light receiving portion detects no light, and it is detected that the container is full of removed toner. This information is transmitted to the main body 13 and displayed directly on an operation panel or a computer, thereby informing a user that the process cartridge B is to be replaced. At this time, since the cleaning chamber 43 is not filled with removed toner, no cleaning defect arises. By providing the fill-up detecting means at the most downstream portion, regardless of the lifetime of the photosensitive drum 15, the cleaning container 14 can be prevented from being full of removed toner, thereby preventing defective cleaning. Also, the main body 13 can be prevented from malfunctioning because of leakage of removed toner.

In the fill-up detecting means according to the embodiment, the fill-up detecting windows 54 and 55 are cleaned with a rotary cleaning blade 56. The rotation direction of the cleaning blade 56 is set to a container rotation direction c, such that the fill-up detecting light transmitting window a54 on the top face of the container is first cleaned, and then the fill-up detecting light transmitting window b55 is wiped. Further to prevent the toner scraped off by the cleaning blade 56 from flowing in, at both sides of the fill-up detecting light transmitting windows, fill-up detecting ribs 57 are disposed for preventing backflow. Even when toner is accumulated to reach the fill-up detecting windows, first light can be transmitted by the cleaning blade 56.

As aforementioned, by providing the constitution of the cleaning container 14 and the conveying method in the cleaning chamber 43 and the removed toner accumulating chamber 44 according to the embodiment, a large volume of removed toner can be accumulated to fulfill the performance of the process cartridge B. Further, there is provided a highly safe process cartridge B which can detect if the container is full of removed toner.

Embodiment 2

Figure 6:
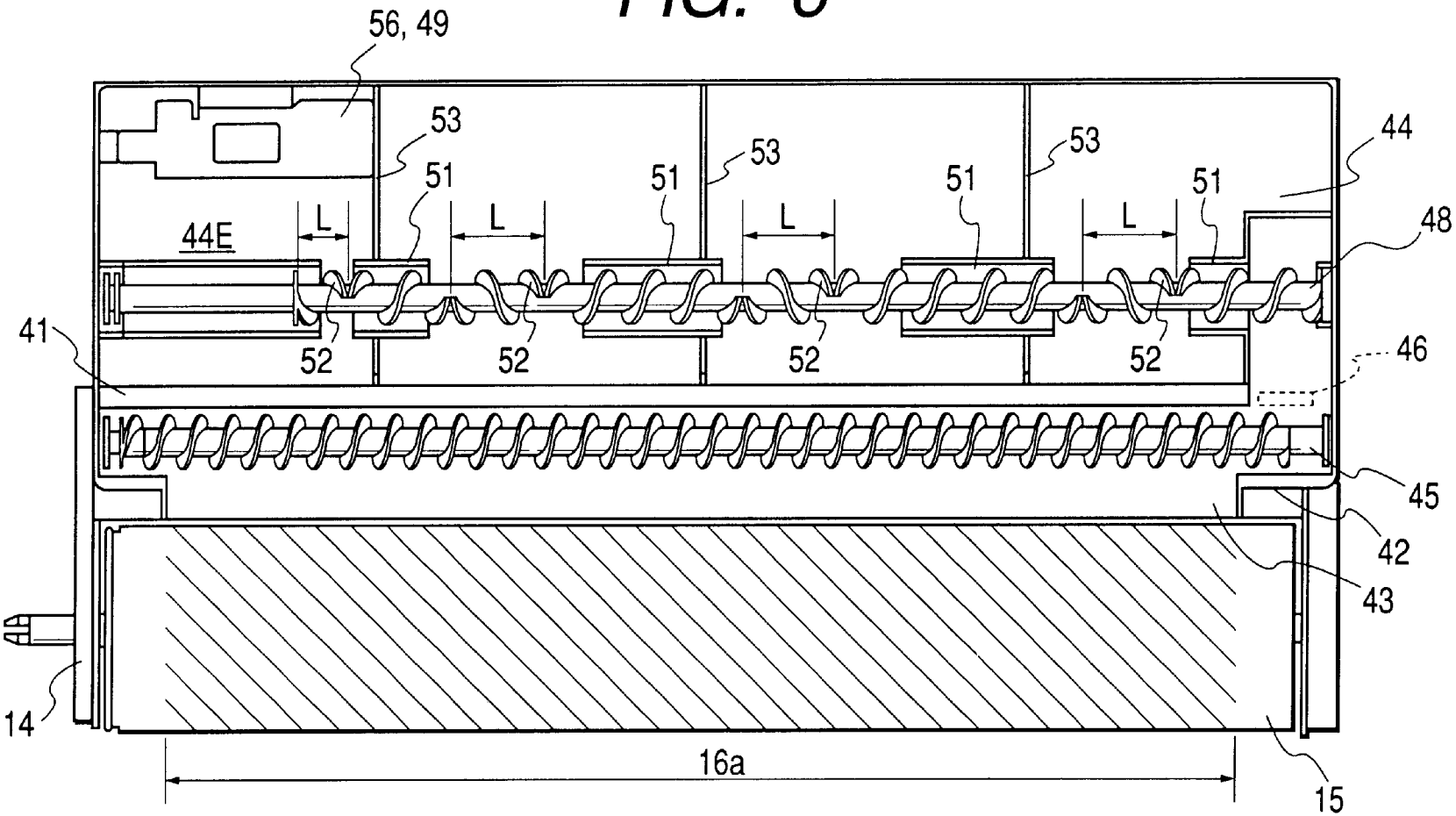
FIG. 6 is a horizontal sectional view of a process cartridge seen from above according to a second embodiment of the invention.

A second embodiment of a cleaning container constitution is described referring to FIG. 6. Only the respects with which the second embodiment differs from the first embodiment are described. The second embodiment is constituted by providing a conveying guide along the screw b48 as the conveying means in the second conveying chamber.

Since the screw b48 in the removed toner accumulating chamber 44 has removed toner chamber conveying guides 51, especially at the upstream side, removed toner is efficiently conveyed, and the upstream portion of the conveying means is advantageously prevented from packing because of excessively compressed toner.

Further, the removed toner chamber conveying guides 51 have a plurality of holes. The holes are positioned to include starting and ending points of a reversed helical configuration. In the removed toner accumulating chamber 44 having such constitution, toner is positively conveyed via the holes into the removed toner accumulating chamber 44, then into the subsequent small chambers. Additionally, since the removed toner chamber conveying guides 51 are disposed across the removed toner chamber partition ribs 53, toner is effectively prevented from flowing in reverse when the cleaning container 14 is tilted. Therefore, the behavior of removed toner is effectively stabilized. Also, even when the cleaning container 14 is tilted with the downstream side having the fill-up detecting means facing downward, removed toner is effectively prevented from flowing in the fill-up detecting chamber by the removed toner chamber conveying guide 51 and the removed toner chamber partition ribs 53. Even if a small quantity of toner flows in the small chamber at the most downstream side, the fill-up detection is not affected.

Embodiment 3

A third embodiment of a constitution of the cleaning container 14 is described with reference to FIGS. 7 and 8. Only the respects in which this embodiment is different from the aforementioned embodiments are described.

Figure 7:
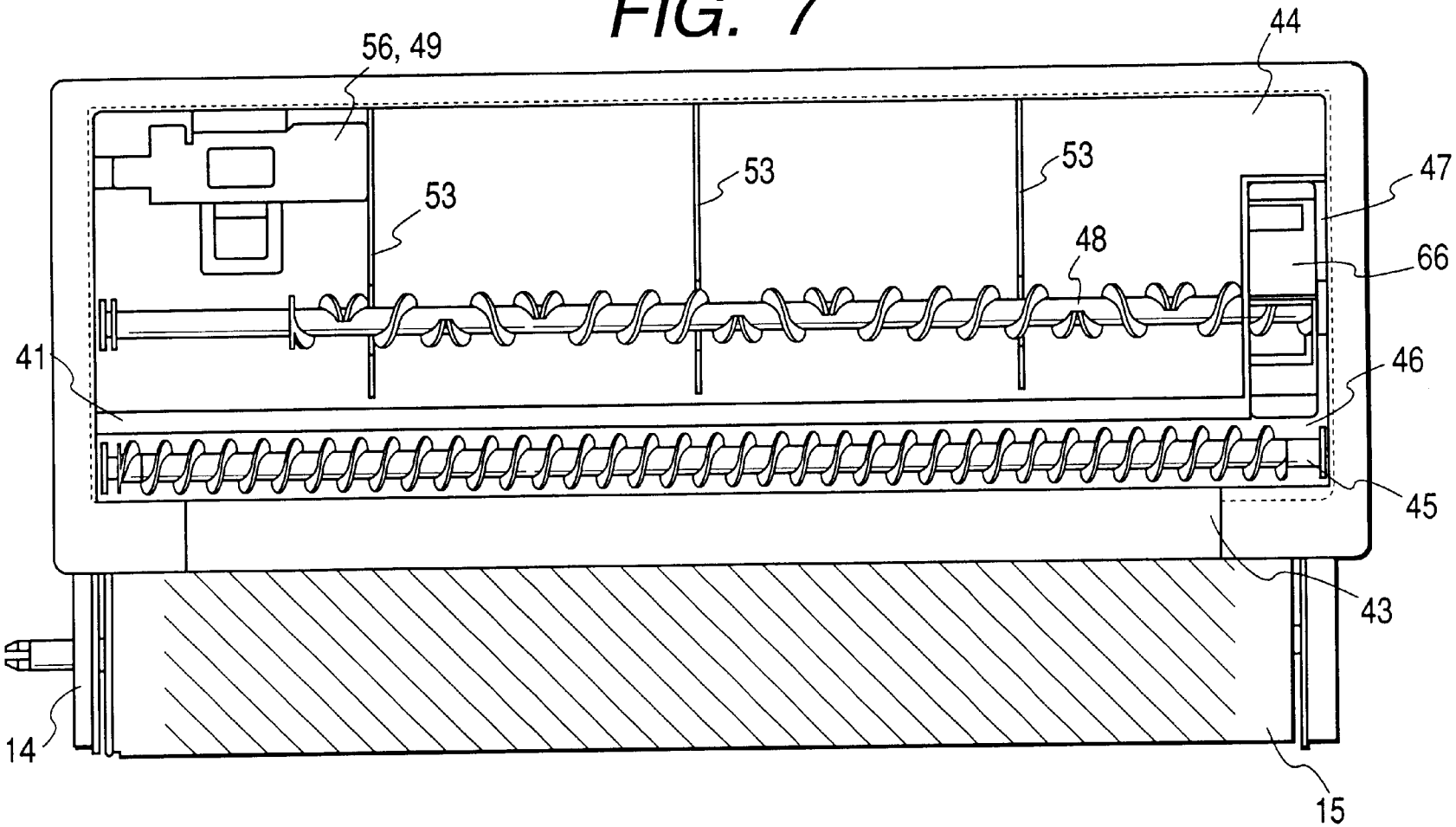
FIG. 7 is a horizontal sectional view of a process cartridge seen from above according to a third embodiment of the invention.
Figure 8:
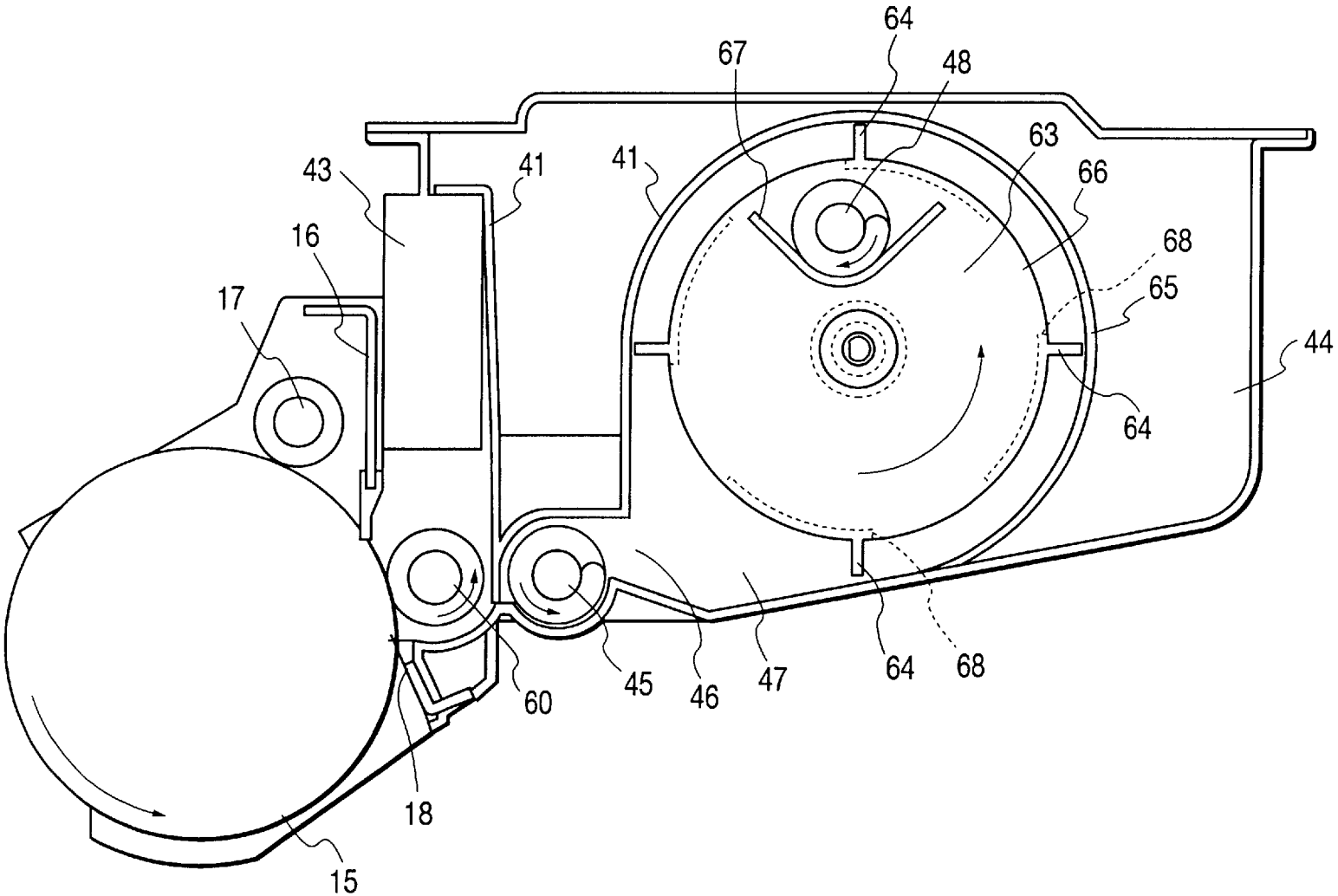
FIG. 8 is a longitudinal sectional view of the process cartridge seen from above according to the third embodiment.

The third embodiment is largely different from the other embodiments in that the cleaning container 14 is partitioned by one partition member 41 shown in FIGS. 7 and 8 into three chambers, i.e., the cleaning chamber 43, the removed toner accumulating chamber 44, and a third chamber or intermediate conveying chamber 47. The opening 46 from the cleaning chamber 43 into the intermediate conveying chamber 47 is positioned outside the range of cleaning process, and is provided with a function of preventing backflow, thereby stabilizing the cleaning process for a long time.

Further in the third embodiment, in the third intermediate conveying chamber 47, an impeller rotating in the intermediate conveying chamber 47 and an intermediate conveying guide 65 push upward the toner conveyed from the cleaning chamber 43. The impeller 63 has one or a plurality of impeller ribs 64 at a constant height in a radial direction on an outer periphery of a cylindrical rotary body, and impeller openings 66 at the upstream side of the rotation direction.

In the third embodiment, the openings 66 are provided at constant intervals at the upstream side of the impeller ribs 64, and are provided with protrusions 68 having a constant length. When toner starts accumulating in the intermediate conveying chamber 47, toner is laid on the impeller ribs 64 of the impeller 63 and pushed upward along the intermediate conveying guide 65. If no protrusions 68 are provided, the pushed up toner is conveyed above the rotation center of the impeller 63, then falls along the impeller ribs 64 via the impeller openings 66 into the impeller 63.

In the embodiment, however, since the protrusions 68 are provided, toner is pushed up to substantially the rotation uppermost portion of the impeller 63, then falls via the impeller openings 66 into the rotary body of the impeller 63. Above the rotation center in the impeller 63, a toner receptacle 67 is positioned as high as possible within a range not interfering with the impeller 63. Fallen toner accumulates in the toner receptacle 67. The toner receptacle 67 also serves as the toner chamber conveying guide 51 of the screw b48 of the removed toner conveying member in the removed toner accumulating chamber 44. Toner starts accumulating from the upstream side in the removed toner accumulating chamber 44.

According to the constitution, in the cleaning container 14, removed toner can be efficiently fed upward in the cleaning container 14. Therefore, the cleaning container 14 can be provided for accumulating removed toner more efficiently in a limited space as compared with the conventional cleaning container. Also, the intermediate conveying chamber 47 serves as a backflow preventive means to prevent toner from accumulating in the cleaning portion.

Other Embodiments

Described are embodiments in which removed toner is conveyed from the cleaning chamber 43 to the intermediate conveying chamber 47 using other conveying members.

Figure 9:
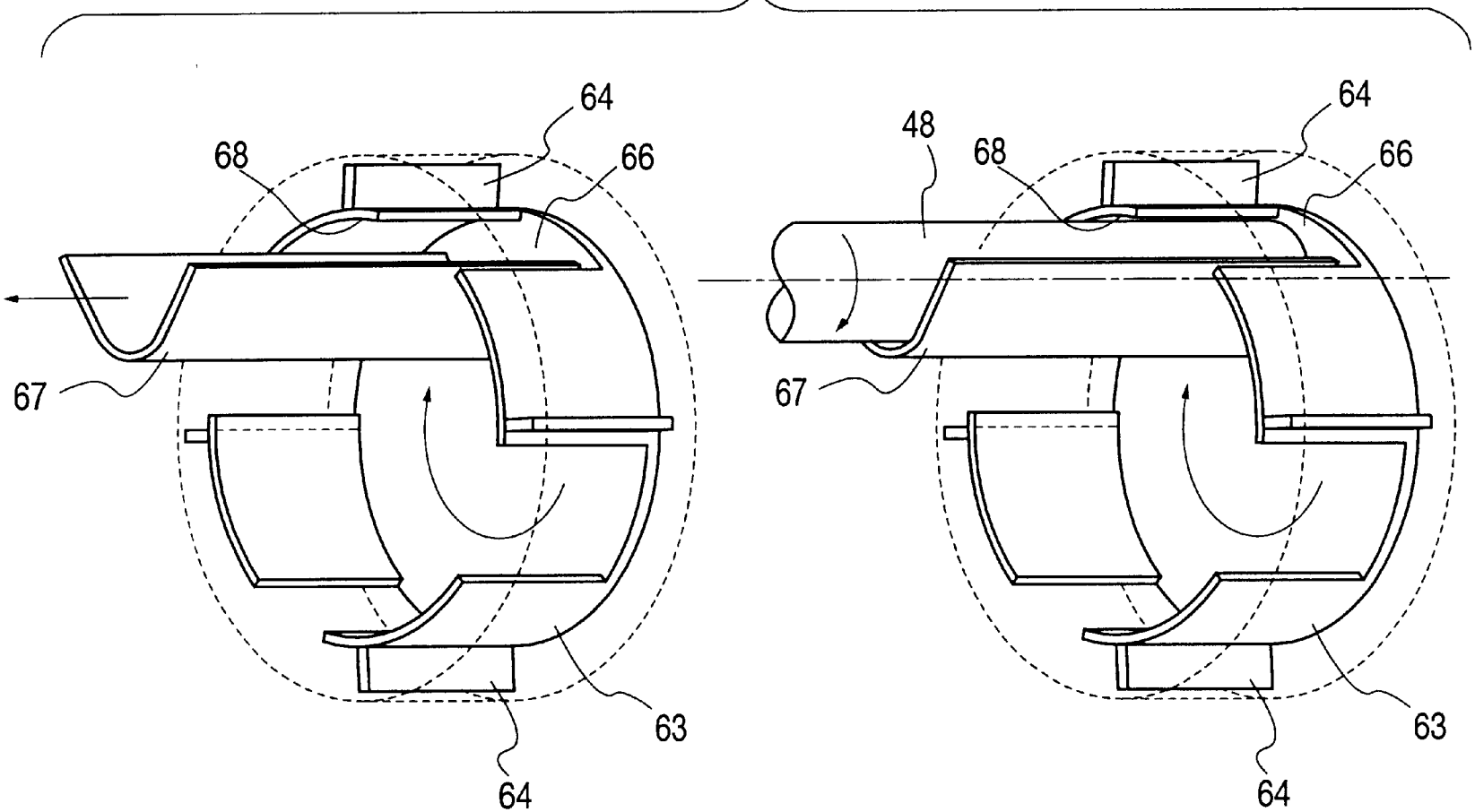
FIG. 9 is a perspective view showing an upward conveying constitution according to the third embodiment.
Figure 10:
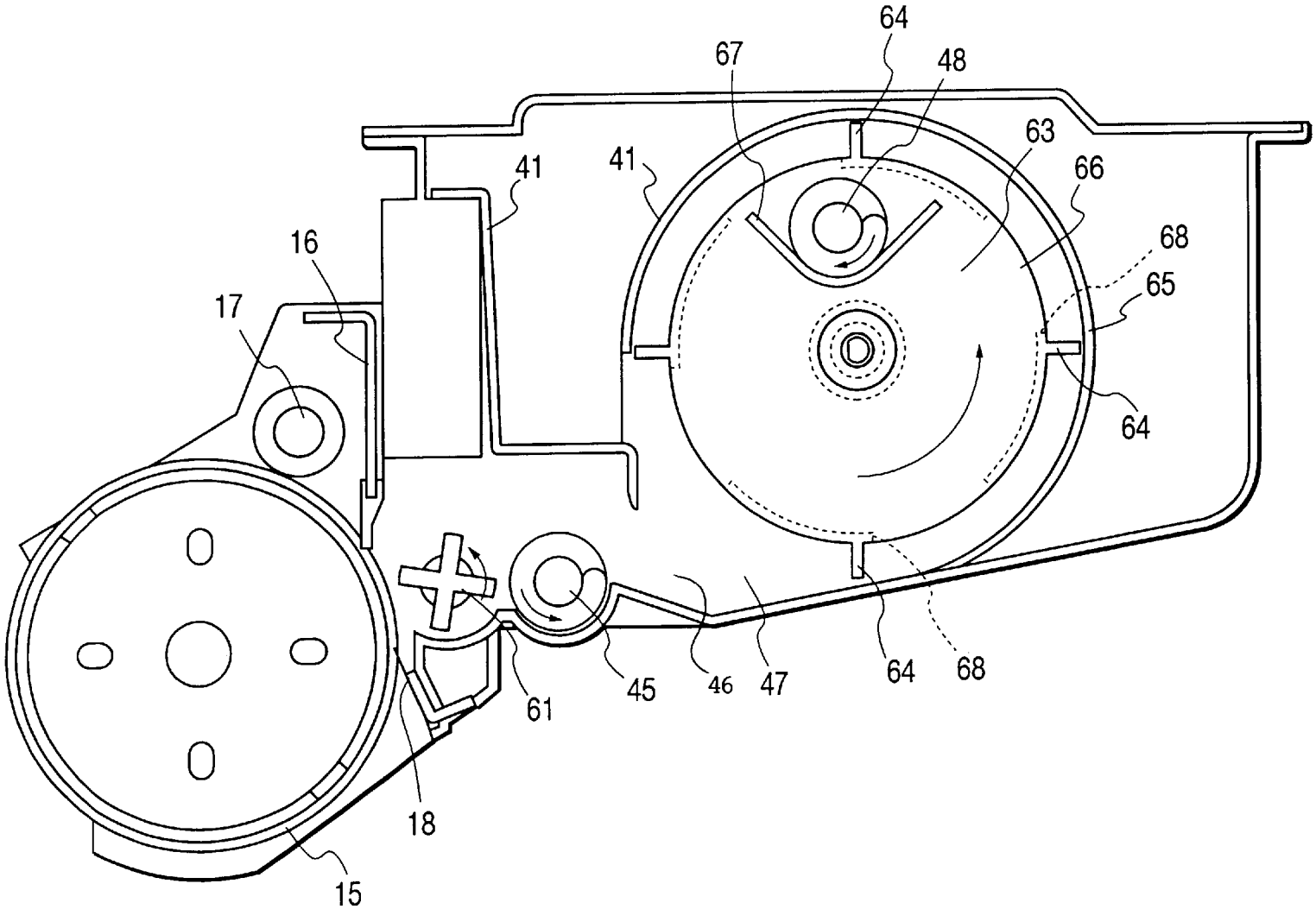
FIG. 10 is a longitudinal sectional view of a process cartridge using another conveying member according to the invention.
Figure 11:
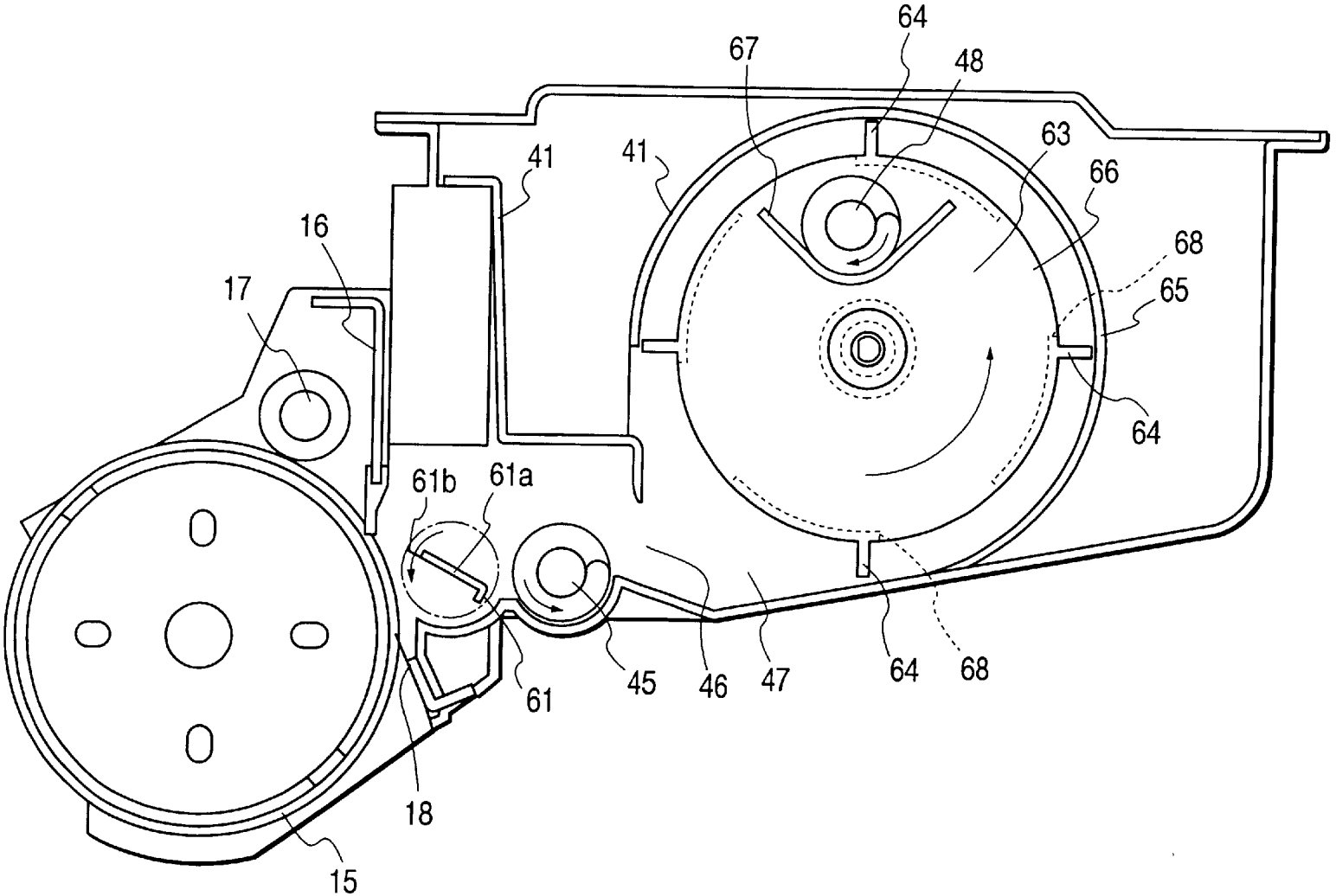
FIG. 11 is a longitudinal sectional view of a process cartridge using another conveying member according to the invention.
Figure 12:
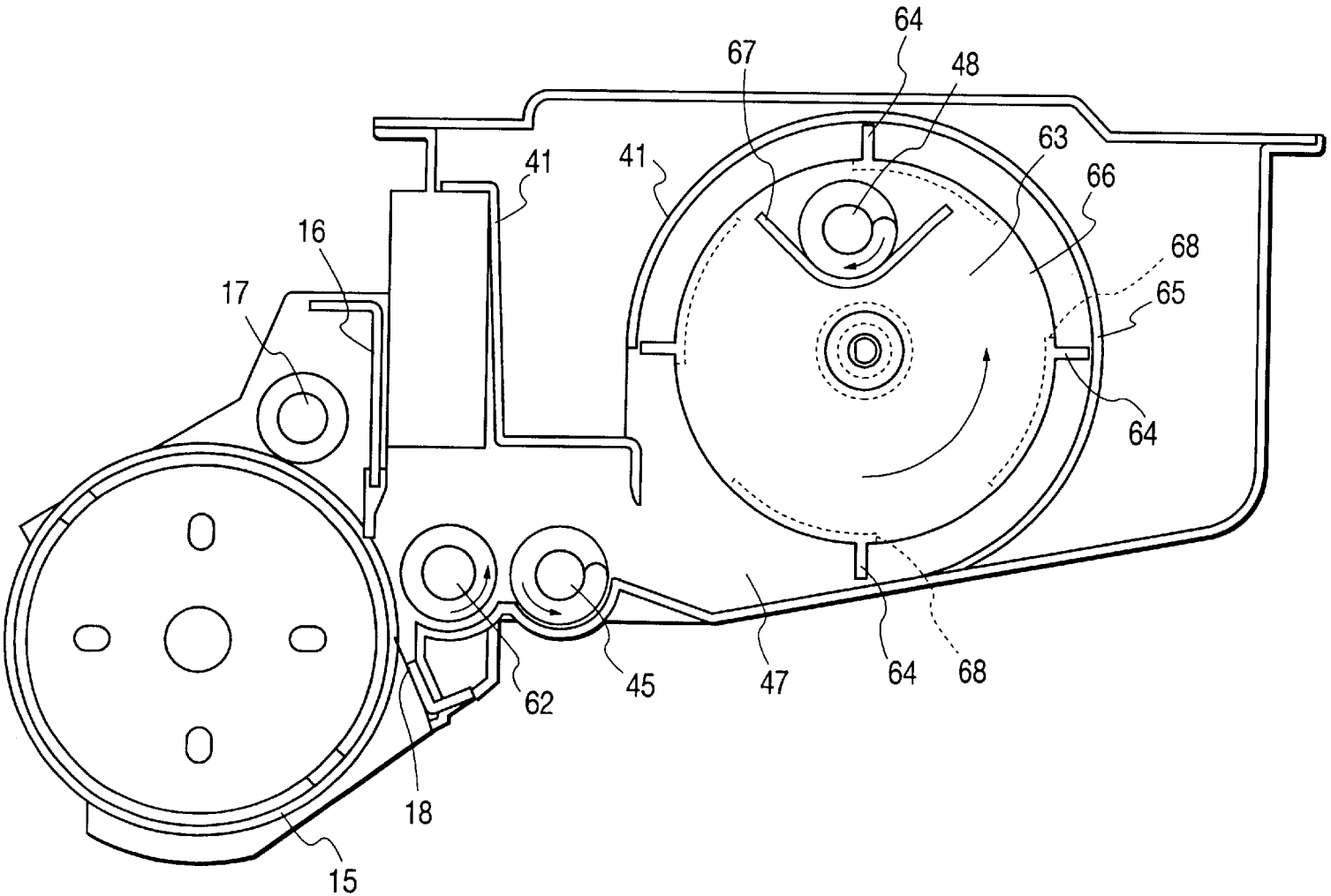
FIG. 12 is a longitudinal sectional view of a process cartridge using another conveying member according to the invention.

FIGS. 10, 11 and 12 show modifications of the means for conveying toner from the cleaning chamber 43 to the intermediate conveying chamber 47 in the cleaning container 14 described using FIGS. 8 and 9. Only the respects in which the conveying means differs from earlier embodiments are described.

In FIGS. 10, 11, regarding the movement direction of the periphery of the photosensitive drum 15, at the upstream side of the cleaning blade 16, a feed blade 61 is provided parallel with the screw a45. FIG. 10 shows the feed blade 61 having an axially perpendicular cross section shaped like a cross and extending long in the axial direction. FIG. 11 shows the feed blade 61 constituted of a rotary sheet metal 61*a* extending long in the axial direction and a resilient soft sheet 61*b* fixed to a longitudinal edge of the sheet metal 61*a*. The feed blade receives a drive force from the main body 13 to rotate counterclockwise, thereby moving toner to the screw a45.

In FIG. 12, a feed member 62 is provided at the position of the aforementioned feed blade 61. The feed member is a roller not abutting on the photosensitive drum, and operates in substantially the same manner as the feed blade 61.

As aforementioned, according to the above embodiments, even when the process cartridge is attached, detached or moved for maintenance during operation, removed toner is prevented from moving from the second chamber to the first chamber. And an adequate cleaning performance can always be maintained. Also, at the time of handling, toner is prevented from leaking via the opening.

According to the above embodiments, the toner conveying member is arranged along the container partition member in a longitudinal direction of the first chamber, and is a screw having an end opposed to the opening. Therefore, the volume occupied by the conveying means is small, the first chamber can be made small, and the toner containing volume of the second chamber can be enlarged.

According to the above embodiments, since a pressure wall for covering the screw is provided opposite to the opening, the opening is sealed from material, and leakage of removed toner is prevented and the second chamber is provided with a conveying means for conveying toner from a side having the opening in a longitudinal direction. Therefore, even an enlarged second removed toner containing volume can be filled with removed toner, and long use is possible.

According to the above embodiments, since the conveying means provided in the second chamber is a screw, toner can be fed deep in the second chamber with a simple member; and since the screw provided in the second chamber has midway therealong a portion twisted in a reverse direction, toner can be successively stored in the second chamber. The second chamber can be filled with toner without leaving any space.

According to the above embodiments, the second chamber is partitioned in a longitudinal direction by a plurality of partition members. The screw of the second chamber is passed through the partition members. Since toner accumulates successively from a small chamber partitioned with a partition member at the upstream side of a toner conveying direction of the screw, toner does not move in the second chamber when handled.

According to the above embodiments, since a small chamber at the most downstream side of the toner conveying direction of the screw in the second chamber is provided with a detecting means for detecting the fill-up with removed toner, use beyond its limitation is prevented; since a conveying guide is provided along the screw of the second chamber for guiding toner fed by the screw so that toner does not fall, toner can be securely conveyed in the longitudinal direction of the cleaning container; and since the conveying guide is provided on a portion excluding the reverse twisted portion of the screw in the second chamber, toner can be successively stored in a predetermined position of the second chamber.

According to the above embodiments, toner in the first chamber is fed by the toner conveying member to the opening in the container partition member, and toner fed via the opening into the third chamber is lifted up in the third chamber to be fed to the second chamber. In the cleaning container, toner particles can be easily fed higher above. As a result, there is no wasted space in the cleaning container, and the cleaning container per se can be prepared in a minimum required size. Different from the prior art having a limitation that the cleaning container should be formed below a cleaning place, the cleaning container can be optionally prepared in accordance with a space in a main body.

According to the above embodiments, the upward conveying means provided in the third chamber is constituted of a cylindrical rotary body, a conveying guide and a fallen toner receptacle. The cylindrical rotary body has a plurality of ribs at a constant height in a radial direction on an outer periphery of a cylindrical configuration, and has an opening at the upstream side in a rotation direction of each rib. The conveying guide is positioned at a certain distance from the outer periphery of the rotary body, and is further provided with the toner receptacle in a rotation axis direction inside the rotary body and above the rotation center of the rotary body for receiving toner falling from the opening in the rotary body. Therefore, toner fed to the third chamber can be efficiently conveyed to a high position.

According to the above embodiments, since the opening at the upstream side of the rotation direction of the rib on the outer periphery of the rotary body as the upward conveying means for conveying the toner upwardly is at a certain distance from the rib, more toner can be moved in an advancing direction of the rib, and toner can be conveyed higher.

According to the above embodiments, since the toner receptacle of the third chamber serves as the conveying guide of the second chamber, toner can be smoothly conveyed from the third chamber to the second chamber; and the main body is prevented from malfunctioning because of using of a cleaning apparatus full of toner.

According to the above embodiments, the cleaning member surely wipes from the first detecting window in the top face, thereby preventing toner from unnecessarily flowing in and maintaining a stabilized light transmitting property; and the cleaning container has ribs with a constant height from a wall of the cleaning container at both sides with a certain distance in a rotation axis direction of the cleaning member from the detecting windows. Therefore, even when toner accumulates in the portions of the detecting windows, toner is prevented from unnecessarily flowing in, and a stabilized light transmitting property can be maintained.

According to the above embodiments, since the opening between the first chamber and the second chamber is outside a range of cleaning process, in all the regions in the range of the cleaning process range, the toner conveying member feeds toner into the opening. Even if toner resulting from the cleaning process accumulates in the vicinity of the opening, cleaning performance is hardly affected.

As mentioned above, the toner can be effectively contained, according to the present invention.

What is claimed is:

1. A cleaning apparatus for use in an electrophotographic image forming apparatus for removing a toner from an electrophotographic photosensitive body and having a cleaning container, comprising:

a first chamber provided with a cleaning member for removing the toner from the electrophotographic photosensitive body;

a second chamber for accumulating the toner removed from the electrophotographic photosensitive body by said cleaning member;

a third chamber provided between the first chamber and the second chamber and having a first toner conveying member for conveying the toner fed from the first chamber into the second chamber;

a second toner conveying member for conveying the toner from the first chamber to the third chamber;

a first partition member for partitioning the first chamber and the third chamber;

an opening portion provided at one end of the photosensitive member in a longitudinal direction thereof, and between the first chamber and the third chamber; and a second partition for partitioning the second chamber and the third chamber;

wherein toner in the first chamber is fed by the second toner conveying member to the opening portion, and the toner fed via the opening portion into the third chamber is lifted up in the third chamber to be fed to the second chamber.

2. The cleaning apparatus according to claim 1, wherein said second toner conveying member is arranged along the first partition member in the longitudinal direction thereof, and is a screw having an end opposed to said opening portion.

3. The cleaning apparatus according to claim 2, wherein a pressure wall for covering the screw is provided opposite to the opening portion.

4. The cleaning apparatus according to claim 1, further comprising a third conveying member provided for conveying the toner in the second chamber in a longitudinal direction thereof.

5. The cleaning apparatus according to claim 4, wherein the third conveying member provided in the second chamber is a screw.

6. The cleaning apparatus according to claim 5, wherein the screw provided in the second chamber has midway therealong a portion twisted in a reverse direction.

7. The cleaning apparatus according to claim 5, wherein the second chamber has small chambers partitioned in a longitudinal direction by a plurality of partition members, and the partition members are provided along the screw of the second chamber.

8. The cleaning apparatus according to claim 7, further comprising detecting means for detecting that a small chamber, at the most downstream side of the toner conveying direction of the screw in the second chamber, is full of removed toner.

9. The cleaning apparatus according to one of claims 4 to 8, wherein a conveying guide is provided along the second chamber screw for guiding toner fed by the screw without causing the toner to fall.

10. The cleaning apparatus according to claim 9, wherein said conveying guide is provided on a portion of the second chamber screw excluding a reverse twisted portion of the screw in the second chamber.

11. The cleaning apparatus according to claim 1, wherein the first toner conveying member conveys the toner upwardly, and the first toner conveying member comprises a cylindrical rotary body, a conveying guide and a fallen toner receptacle, wherein said cylindrical rotary body has a plurality of ribs at a constant height in a radial direction from an outer periphery of a cylindrical configuration and an opening position at the upstream side in a rotation direction of each rib, and wherein said conveying guide is positioned at a certain distance from the outer periphery of the rotary body and is provided with said toner receptacle in a rotation axis direction inside the rotary body and above the rotation center of the rotary body for receiving toner falling from the opening portion in the rotary body.

12. The cleaning apparatus according to claim 11, wherein the opening portion at the upstream side in the rotation direction of the rib on the outer periphery of the rotary body of the first conveying member is at a certain distance from the rib.

13. The cleaning apparatus according to claim 9, wherein the toner receptacle of said third chamber serves as the conveying guide of the second chamber.

14. A process cartridge detachably attached to a main body of an electrophotographic image forming apparatus, comprising:

an electrophotographic photosensitive drum; and a cleaning apparatus for removing toner remaining on said electrophotographic photosensitive drum, said cleaning apparatus including a cleaning container:

a first chamber provided with a cleaning member for removing the toner from the electrophotographic photosensitive drum;

a second chamber for accumulating the toner removed from the electrophotographic photosensitive drum by said cleaning member;

a third chamber provided between the first chamber and the second chamber and having a first toner conveying member for conveying the toner fed from the first chamber into the second chamber; and a second toner conveying member for conveying the toner from the first chamber to the third chamber, wherein toner in the first chamber is fed by the second toner conveying member to an opening portion between the first and third chambers and the toner fed via the opening portion into the third chamber is lifted up in the third chamber to be fed to the second chamber.

15. The process cartridge according to claim 14, wherein said second toner conveying member is arranged along a first partition member, partitioning the first and third chambers, in the longitudinal direction thereof, and is a screw having an end opposed to said opening portion.

16. The process cartridge according to claim 15, wherein a pressure wall for covering the screw is provided opposite to the opening portion.

17. The process cartridge according to claim 14, further comprising a third conveying member for conveying the toner in the second chamber in a longitudinal direction thereof.

18. The process cartridge according to claim 14, wherein the third conveying member provided in the second chamber is a screw.

19. The process cartridge according to claim 14, wherein the screw provided in the second chamber has midway therealong a portion twisted in a reverse direction.

20. The process cartridge according to claim 14, wherein the second chamber has a screw therein and has small chambers partitioned in a longitudinal direction by a plurality of partition members, and the partition members are provided along the screw of the second chamber.

21. The process cartridge according to claim 14, further comprising detecting means for detecting that a small chamber at the most downstream side of the toner conveying direction of a screw in the second chamber is full of removed toner.

22. The process cartridge according to one of claims 17 to 21, wherein a conveying guide is provided along a second chamber screw for guiding toner fed by the screw without causing the toner to fall.

23. The process cartridge according to claim 22, wherein said conveying guide is provided on a portion of said second chamber screw excluding a reverse twisted portion of the screw in the second chamber.

24. The process cartridge according to claim 14, wherein the first toner conveying member conveys the toner upwardly, and the first toner conveying member comprises a cylindrical rotary body, a conveying guide and a fallen toner receptacle, wherein said cylindrical rotary body has a plurality of ribs at a constant height in a radial direction from an outer periphery of a cylindrical configuration and an opening portion at the upstream side in a rotation direction of each rib, and wherein said conveying guide is positioned at a certain distance from the outer periphery of the rotary body and is provided with said toner receptacle in a rotation axis direction inside the rotary body and above the rotation center of the rotary body for receiving toner falling from the opening portion in the rotary body.

25. The process cartridge according to claim 14, wherein the opening portion at the upstream side in the rotation direction of the rib on the outer periphery of the rotary body of the first conveying member is at a certain distance from the rib.

26. The process cartridge according to claim 14, wherein a toner receptacle of said third chamber serves as the conveying guide of the second chamber.

27. The cleaning apparatus for use in an electrophotographic image forming apparatus for removing a toner from an electrophotographic photosensitive body, comprising:

a first chamber provided with a cleaning member for removing the toner from the electrophotographic photosensitive body;

a second chamber for accumulating toner removed from said electrophotographic photosensitive body by said cleaning member;

a toner conveying member for conveying toner from the first chamber to the second chamber; and a pair of detecting windows opposed in the second chamber for detecting that toner has a volume to be stored in the second chamber, a cleaning blade for cleaning the windows and a light emitting portion and receiving portion opposed to each other outside a cleaning container.

28. The cleaning apparatus according to claim 27, wherein said cleaning apparatus includes a cleaning container in which a first detecting window of the opposed detecting windows is positioned in a top face of the cleaning container, a second detecting window is positioned in a side face of the cleaning container to be cleaned by the detecting windows while rotating, and wherein a rotation direction is set such that the cleaning member cleans from the first detecting window.

29. The cleaning apparatus according to claim 27, wherein said cleaning apparatus includes a cleaning container in which a first detecting window of the opposed detecting windows is positioned in a top face of the cleaning container, a second detecting window is positioned in a side face of the cleaning container to be cleaned by the detecting windows while rotating, and wherein the cleaning container has ribs with a constant height from a wall of the cleaning container at both sides with a certain distance in a rotation axis direction of the cleaning member from the detecting windows so that the ribs are inside a rotation locus of a cleaning blade in a rotation axis radial direction.

30. A cleaning apparatus for use in an image forming apparatus for removing a toner from a photosensitive member, comprising:

a first chamber provided with a cleaning member for removing the toner from the photosensitive member;

a second chamber for accumulating the toner removed from the photosensitive member by the cleaning member;

an opening portion provided at one end of said first chamber, wherein the toner in said first chamber is fed into said second chamber via said opening portion;

a screw for conveying the toner to said opening portion provided at one end of said first chamber, wherein said opening portion is opened along a conveying direction of said screw; and a pressure wall adjacent to said screw, wherein said pressure wall is adjacent to an end of said screw opposed to said opening portion, wherein an outer circumference, in a rotating direction of said screw, of the end of said screw opposed to said opening portion is covered by said opening portion and said pressure wall.

31. The cleaning apparatus according to claim 30, wherein said pressure wall is bent along the outer circumference in the rotating direction of said screw.

32. The cleaning apparatus according to claim 30, wherein the toner fed from said opening portion is lifted up in said second chamber.

33. The cleaning apparatus according to claim 30, wherein said opening portion is provided at one end of said first chamber in a longitudinal direction of the photosensitive member.

34. The cleaning apparatus according to claim 30, wherein said opening portion is outside a range of a cleaning process.

35. A process cartridge detachably attached to a main body of an image forming apparatus, comprising:

a photosensitive member; and a cleaning apparatus for removing toner from said photosensitive member, wherein said cleaning apparatus includes a first chamber provided with a cleaning member for removing the toner from the photosensitive member; a second chamber for accumulating the toner removed from the photosensitive member by the cleaning member; an opening portion provided at one end of said first chamber, wherein toner in the first chamber is fed into the second chamber via said opening portion; a screw for conveying the toner to said opening portion provided at one end of said first chamber, wherein the opening portion is opened along a conveying direction of the screw; and a pressure wall adjacent to the screw, wherein the pressure wall is adjacent to an end of the screw opposed to the opening portion, wherein, at the end of the screw opposed to the opening portion, an outer circumference in a rotating direction of the screw is covered by the opening portion and said pressure wall.

36. The process cartridge according to claim 35 wherein the pressure wall is bent along the outer circumference in the rotating direction of the screw.

37. The process cartridge according to claim 35, wherein the toner fed from the opening portion is lifted up in the second chamber.

38. The process cartridge according to claim 35, wherein the opening portion is provided at one end of the first chamber in a longitudinal direction of the photosensitive member.

39. The process cartridge according to claim 35, wherein the opening portion is outside a range of a cleaning process.

40. A cleaning apparatus for use in an image forming apparatus for removing a toner from the photosensitive member, comprising:

a cleaning member for removing the toner from the photosensitive member;

a chamber for accumulating the toner removed from the photosensitive member by said cleaning member;

an opening portion provided at one end of said chamber, wherein the toner removed from the photosensitive member is fed from said opening portion into said chamber; and a screw provided in said chamber for conveying the toner fed from said opening portion, wherein said screw has a portion twisted in a reverse direction.

41. The cleaning apparatus according to claim 40, wherein said screw has a reversed twisted portion midway along said screw.

42. The cleaning apparatus according to claim 40, wherein said opening portion is provided at one end of said chamber in a longitudinal direction thereof.

43. The cleaning apparatus according to claim 40, wherein said screw conveys the toner in a longitudinal direction of said chamber.

44. The cleaning apparatus according to claim 40, wherein said screw is positioned upward in said chamber.

45. The cleaning apparatus according to claim 40, wherein said screw extends in a horizontal direction.

46. The cleaning apparatus according to claim 40, further comprising a partition member for partitioning said chamber into small chambers along a conveying direction of said screw, wherein said screw is provided along said partition member.

47. The cleaning apparatus according to claim 46, wherein said screw is provided above said partition member.

48. The cleaning apparatus according to claim 46, wherein said partition member is provided downstream of a reversed twisted portion of said screw in the conveying direction of said screw.

49. The cleaning apparatus according to claim 46, further comprising detecting means for detecting whether a small chamber at a most downstream side in the conveying direction of said screw is full.

50. The cleaning apparatus according to claim 40, further comprising a conveying guide provided along said screw for guiding the toner fed by the screw without causing the toner to fall.

51. The cleaning apparatus according to claim 50, wherein said conveying guide is provided on a portion of said screw excluding the reverse twisted portion of said screw.

52. A process cartridge detachably attached to a main body of an image forming apparatus, comprising:

a photosensitive member; and a cleaning apparatus for removing toner from said photosensitive member, wherein said cleaning apparatus includes a cleaning member for removing the toner from the photosensitive member; a chamber for accumulating the toner removed from the photosensitive member by the cleaning member; and opening portion provided at one end of the chamber, wherein the toner removed from the photosensitive member is fed from the opening portion into the chamber; and a screw provided in the chamber for conveying the toner fed from the opening portion, wherein the screw has a portion twisted in a reverse direction.

53. The process cartridge according to claim 52, wherein the screw has a reverse twisted portion midway along the screw.

54. The process cartridge according to claim 52, wherein said opening portion is provided at one end of the chamber in a longitudinal direction thereof.

55. The process cartridge according to claim 52, wherein the screw conveys the toner in a longitudinal direction of the chamber.

56. The process cartridge according to claim 52, wherein the screw is positioned upward in the chamber.

57. The process cartridge according to claim 52, wherein the screw extends in a horizontal direction.

58. The process cartridge according to claim 52, further comprising a partition member for partitioning the chamber into small chambers along the conveying direction of the screw, wherein said screw is provided along said partition member.

59. The process cartridge according to claim 58, wherein the screw is provided above the partition member.

60. The process cartridge according to claim 58, wherein the partition member is provided downstream of a reversed twisted portion of the screw in the conveying direction of the screw.

61. The process cartridge according to claim 58, further comprising detecting means for detecting whether a small chamber at a most downstream side in the conveying direction of the screw is full.

62. The process cartridge according to claim 52, further comprising a conveying guide provided along the screw of guiding the toner fed by the screw without causing the toner to fall.

63. The process cartridge according to claim 62, wherein said conveying guide is provided along the screw on a portion excluding the reverse twisted portion of the screw.

64. A cleaning apparatus for use in an image forming apparatus for removing a toner from a photosensitive member, comprising:

a cleaning member for removing the toner from the photosensitive member;

a chamber for accumulating the toner removed from the photosensitive member by said cleaning member;

an opening portion provided at one end of said chamber, wherein the toner removed from the photosensitive member is fed from said opening portion into said chamber;

a toner conveying member provided in said chamber for conveying the toner fed from said opening portion; and a partition member for partitioning said chamber into small chambers which are arranged side by side along the conveying direction of said toner conveying member, wherein said partition member crosses said conveying member.

65. The cleaning apparatus according to claim 64, wherein said opening portion is provided at one end of said chamber in a longitudinal direction thereof.

66. The cleaning apparatus according to claim 64, wherein said toner conveying member conveys the toner in a longitudinal direction of said chamber.

67. The cleaning apparatus according to claim 64, wherein said toner conveying member is provided above said partition member.

68. The cleaning apparatus according to claim 64, wherein said toner conveying member is positioned upward in said chamber.

69. The cleaning apparatus according to claim 64, wherein said toner conveying member conveys the toner in a horizontal direction.

70. The cleaning apparatus according to claim 64, further comprising detecting means for detecting whether a small chamber at a most downstream side in the conveying direction of said toner conveying member is full.

71. The cleaning apparatus according to one of claim 64 to 70, wherein said toner conveying member is a screw.

72. The cleaning apparatus according to claim 71, further comprising a conveying guide provided along the screw for guiding the toner fed by the screw without causing the toner to fall.

73. The cleaning apparatus according to claim 64, further comprising a second conveying member for conveying the toner removed from photosensitive member by said cleaning member to said chamber, wherein said second conveying member conveys the toner upward.

74. A process cartridge detachably attached to a main body of an image forming apparatus, comprising:

a photosensitive member; and a cleaning apparatus for removing toner from said photosensitive member, wherein said cleaning apparatus includes a cleaning member for removing the toner from said photosensitive member; a chamber for accumulating the toner removed from said photosensitive member by said cleaning member; an opening portion provided at one end of the chamber, wherein the toner removed from said photosensitive member is fed from the opening portion into the chamber; a toner conveying member provided in the chamber for conveying the toner fed from the opening portion; and a partition member for partitioning the chamber into small chambers which are arranged side by side along the conveying direction of the toner conveying member, wherein the partition member crosses the conveying member.

75. The process cartrdige according to claim 74, wherein the opening portion is provided at one end of the chamber in a longitudinal direction thereof.

76. The process cartridge according to claim 74, wherein the toner conveying member conveys the toner in the longitudinal direction of the chamber.

77. The process cartridge according to claim 74, wherein the toner conveying member is provided above the partition member.

78. The process cartridge according to claim 74, wherein the toner conveying member is positioned upward in the chamber.

79. The process cartridge according to claim 74, wherein the toner conveying member conveys the toner in a horizontal direction.

80. The process cartridge according to claim 74, further comprising detecting means for detecting whether a small chamber at a most downstream side in the conveying direction of the toner conveying member is full.

81. The process cartridge according to one of claims 74 to 80, wherein the toner conveying member is a screw.

82. The process cartridge according to claim 81, further comprising a conveying guide provided along the screw for guiding the toner fed by the screw without causing the toner to fall.

83. The process cartridge according to claim 74, further comprising a second conveying member for conveying the toner removed from photosensitive member by said cleaning member to said chamber, wherein said second conveying member conveys the toner upward.

84. A cleaning apparatus for use in an image forming apparatus for removing a toner from a photosensitive member comprising:

a first chamber provided with a cleaning member for removing the toner from the photosensitive member;

a second chamber for accumulating the toner removed from the photosensitive member by the cleaning member; and a third chamber provided between said first chamber and said second chamber and having a toner conveying member for conveying the toner fed from said first chamber into the second chamber;

wherein the toner fed into said third chamber is lifted up in said third chamber to be fed to said second chamber by the toner conveying member.

85. The cleaning apparatus according to claim 84, wherein the toner conveying member comprises a cylindrical rotary body, a conveying guide, and a fallen toner receptacle, wherein the cylindrical rotary body has a plurality of ribs at a constant height in a radial direction from an outer periphery of a cylindrical configuration and an opening portion at the upstream side in a rotation direction of each rib, and wherein the conveying guide is positioned at a certain distance from the outer periphery of the rotary body and is provided with a toner receptacle in a rotation axis direction inside the rotary body and above the rotation center of the rotary body for receiving toner falling from the opening portion in the rotary body.

86. The cleaning apparatus according to claim 85, wherein the opening portion at the upstream side in the rotation direction of the rib on the outer periphery of the rotary body of the conveying member is at a certain distance from the rib.

87. The cleaning apparatus according to claim 85, wherein the toner receptacle of the third chamber serves as the conveying guide of said second chamber.

88. A process cartridge detachably attached to a main body of an image forming apparatus, comprising:

a photosensitive member; and a cleaning apparatus for removing toner from said photosensitive member, wherein said cleaning apparatus includes a first chamber provided with a cleaning member for removing the toner from the photosensitive member; a second chamber for accumulating the toner removed from the photosensitive member by said cleaning member; a third chamber provided between the first chamber and the second chamber and having a toner conveying member for conveying the toner fed from the first chamber into the second chamber; wherein the toner fed into the third chamber is lifted up in the third chamber to be fed to the second chamber by said toner conveying member.

89. The process cartridge according to claim 88, wherein the toner conveying member comprises a cylindrical rotary body, a conveying guide and a fallen toner receptacle, wherein the cylindrical rotary body has a plurality of ribs at a constant height in a radial direction from an outer periphery of a cylindrical configuration and an opening portion at the upstream side in a rotation direction of each rib, and wherein the conveying guide is positioned at a certain distance from the outer periphery of the rotary body and is provided with the fallen toner receptacle in a rotation axis direction inside the rotary body and above the rotation center of the rotary body for receiving toner falling from the opening portion in the rotary body.

90. The process cartridge according to claim 89, wherein the opening portion at the upstream side in the rotation direction of the rib on the outer periphery of the rotary body of the conveying member is at a certain distance from the rib.

91. The process of cartridge according to claim 89, wherein the fallen toner receptacle of said third chamber serves as the conveying guide of the second chamber.

92. A cleaning apparatus for use in an image forming apparatus for removing a toner from a photosensitive member, comprising:

a cleaning member for removing the toner from the photosensitive member;

a toner container for accumulating toner removed from the photosensitive member by said cleaning member;

a pair of light transmitting windows provided in said toner container for detecting accumulated toner in said toner container; and a cleaning member for cleaning said pair of light transmitting windows, wherein said cleaning member is provided in said toner container.

93. The cleaning apparatus according to claim 92, wherein said cleaning member rotates to clean said pair of light transmitting windows.

94. The cleaning apparatus according to claim 92, wherein said pair of windows are provided between a light emitting portion and a light receiving portion which are opposed to each other outside said toner container for detecting the toner accumulated in said toner container.

95. A process cartridge detachably attached to a main body of an image forming apparatus, comprising:

a photosensitive member; and a cleaning apparatus for removing toner from said photosensitive member, wherein said cleaning apparatus includes a cleaning member for removing the toner from said photosensitive member; a toner container for accumulating toner removed from said photosensitive member by said cleaning member; a pair of light transmitting windows provided in the toner container for detecting accumulated toner in the toner container; and a cleaning member for cleaning the pair of light transmitting windows, wherein said cleaning member is provided in the toner container.

96. A process cartridge according to claim 95, wherein said cleaning member rotates to clean the pair of light transmitting windows.

97. A process cartridge according to claim 95, wherein the pair of windows are provided between a light emitting portion and a light receiving portion which are opposed to each other outside the toner container for detecting the toner accumulated in the toner container.

98. The cleaning apparatus according to claim 40, wherein said apparatus includes a partition member for partitioning said chamber into small chambers which are arranged side by side along said screw and said screw has reversed twisted portions in each of said small chambers.

99. The cleaning apparatus according to claim 52, wherein said apparatus includes a partition member for partitioning said chamber into small chambers which are arranged side by side along said screw and said screw has reversed twisted portions in each of said small chambers.

100. A cleaning apparatus for use in an image forming apparatus for removing a toner from a photosensitive member, comprising:

a cleaning member for removing the toner from the photosensitive member;

a chamber for accumulating the toner removed from the photosensitive member by said cleaning member;

an opening portion provided at one end of said chamber, wherein the toner removed from the photosensitive member is fed from said opening portion into said chamber;

a toner conveying member provided in said chamber for conveying the toner fed from said opening portion; and a plurality of partition members for partitioning said chamber into small chambers along the conveying direction of said toner conveying member, wherein said small chambers are arranged side by side along said conveying member.

101. A process cartridge detachably attached to a main body of an image forming apparatus, comprising:

a photosensitive member; and a cleaning apparatus for removing toner from said photosensitive member, wherein said cleaning apparatus includes a cleaning member for removing the toner from said photosensitive member; a chamber for accumulating the toner removed from said photosensitive member by said cleaning member; an opening portion provided at one end of the chamber, wherein the toner removed from said photosensitive member is fed from the opening portion into the chamber; a toner conveying member provided in the chamber for conveying the toner fed from the opening portion; and a plurality of partition members for partitioning the chamber into small chambers along the conveying direction of the toner conveying member, wherein the small chambers are arranged side by side along the conveying member.

* * * * *

UNITED STATES PATENT AND TRADEMARK OFFICE

CERTIFICATE OF CORRECTION

PATENT NO. : 6,298,217 B1
DATED : October 2, 2001
INVENTOR(S) : Kazunari Murayama et al.

It is certified that error appears in the above-identified patent and that said Letters Patent is hereby corrected as shown below:

Title page,
Item [57], ABSTRACT,
Line 13, “ribs, guide.” should read -- ribs and a guide. --.

Column 1,
Line 12, “(e.g.” should read -- (e.g., --.
Line 48, “summary of” should read -- object of the present --.

Column 3,
Line 20, “charged” should read -- charging --.

Column 5,
Line 3, “or” should read -- or when it --.
Lines 30 and 39, “i.e.” should read -- i.e., --.

Column 8,
Line 32, “first” should be deleted.

Column 10,
Line 7, “FIGS. 10, 11,” should read -- FIGS. 10 and 11, --.

Column 13,
Line 26, “a clean-” should read -- ¶a clean- --.
Line 29, “container:” should read -- container comprising: --.

Column 14,
Line 38, “The” should read -- A --.

Column 16,
Line 1, “claim 35” should read -- claim 35, --.

Column 17,
Line 4, “and” should read -- and an --.
Line 40, “of” should read -- for --.

UNITED STATES PATENT AND TRADEMARK OFFICE

CERTIFICATE OF CORRECTION

PATENT NO. : 6,298,217 B1
DATED : October 2, 2001
INVENTOR(S) : Kazunari Murayama et al.

It is certified that error appears in the above-identified patent and that said Letters Patent is hereby corrected as shown below:

Column 18,
Line 16, "claim 64" should read -- claims 64 --.
Line 23, "from" should read -- from the --.

Column 19,
Line 3, "from" should read -- from the --.
Line 8, "ber" should read -- ber, --.

Column 20,
Line 10, "of" should be deleted.

Signed and Sealed this

Twenty-ninth Day of April, 2003

JAMES E. ROGAN
*Director of the United States Patent and Trademark Office*